US009376125B2

(12) United States Patent
Bigras et al.

(10) Patent No.: US 9,376,125 B2
(45) Date of Patent: Jun. 28, 2016

(54) HEAT RESISTANT FLOOR ASSEMBLY FOR A RAIL VEHICLE

(71) Applicant: BOMBARDIER TRANSPORTATION GmbH, Berlin (DE)

(72) Inventors: Martin Bigras, Longueuil (CA); Andrée Hebert, St-Nicéphore (CA); Guillaume Chouinard, Chambly (CA); Sylvie Houle, St-Bruno (CA)

(73) Assignee: Bombardier Transportation GmbH, Berlin (DE)

( * ) Notice: Subject to any disclaimer, the term of this patent is extended or adjusted under 35 U.S.C. 154(b) by 107 days.

(21) Appl. No.: 13/775,345

(22) Filed: Feb. 25, 2013

(65) Prior Publication Data

US 2014/0238262 A1 Aug. 28, 2014

(30) Foreign Application Priority Data

Feb. 20, 2013 (CA) ..... 2806886

(51) Int. Cl.
*B61D 17/10* (2006.01)
*B61D 17/00* (2006.01)
*B61F 1/08* (2006.01)

(52) U.S. Cl.
CPC ..... *B61D 17/10* (2013.01); *B61D 17/00* (2013.01); *B61F 1/08* (2013.01)

(58) Field of Classification Search
CPC ..... B61D 17/10
USPC ..... 105/422
See application file for complete search history.

(56) References Cited

U.S. PATENT DOCUMENTS

| | | | | | |
|---|---|---|---|---|---|
| 3,604,365 | A * | 9/1971 | Wall | B61D 45/001 | 105/422 |
| 4,794,032 | A * | 12/1988 | Fujii et al. | | 428/209 |
| 5,740,635 | A * | 4/1998 | Gil et al. | | 52/79.1 |
| 5,834,535 | A * | 11/1998 | Abu-Isa et al. | | 523/179 |
| 7,862,101 | B2 * | 1/2011 | Lusk et al. | | 296/178 |
| 2007/0269645 | A1 * | 11/2007 | Raghavendran et al. | | 428/292.1 |
| 2008/0036240 | A1 * | 2/2008 | Lusk et al. | | 296/178 |
| 2011/0049935 | A1 * | 3/2011 | Locher et al. | | 296/193.07 |
| 2011/0136401 | A1 | 6/2011 | Hanusa et al. | | |
| 2011/0147358 | A1 | 6/2011 | Kober et al. | | |
| 2011/0278396 | A1 * | 11/2011 | Lieven et al. | | 244/119 |
| 2013/0112105 | A1 * | 5/2013 | Gregorits | | 105/422 |
| 2013/0213259 | A1 * | 8/2013 | Taguchi et al. | | 105/422 |
| 2013/0220169 | A1 * | 8/2013 | Taguchi et al. | | 105/397 |
| 2014/0083321 | A1 * | 3/2014 | Kato et al. | | 105/413 |

FOREIGN PATENT DOCUMENTS

| | | | | |
|---|---|---|---|---|
| AU | 2006235991 | A1 | 5/2007 | |
| DE | 2908823 | A1 | 9/1980 | |
| EP | 0241116 | A1 | 10/1987 | |
| EP | 2100791 | A1 * | 9/2009 | B61D 17/10 |
| WO | 2007056840 | A1 | 5/2007 | |
| WO | 2008/135190 | A1 | 11/2008 | |

* cited by examiner

*Primary Examiner* — Zachary Kuhfuss
(74) *Attorney, Agent, or Firm* — The Webb Law Firm

(57) ABSTRACT

The present document describes a heat resistant floor assembly for a rail vehicle. The heat resistant floor assembly comprising: a floor structure and a fire protection panel made of a composite material connected underneath the floor structure.

23 Claims, 9 Drawing Sheets

HEAT RESISTANT FLOOR ASSEMBLY FOR A RAIL VEHICLE

CROSS-REFERENCE TO RELATED APPLICATIONS

This application claims priority of Canadian patent application no. (not yet available), filed on Feb. 20, 2013, the specification of which is hereby incorporated by reference.

BACKGROUND (a) Field

The subject matter disclosed generally relates to rail car structures. More particularly, the subject matter relates to heat resistant floor assemblies for rail vehicles and to heat resistant panel assemblies for rail vehicles for providing structures heat resistant properties.

(b) Related Prior Art

Some vehicle, such as trains, cars, and planes, but also some buildings, must undergo a plurality of different tests before they can be commercialized. For example, trains and certain buildings must overcome some tests related to heat resistant properties and fire resistant properties. Under some regulations, a train must be able to withstand temperatures reaching as high as 850° C. after 30 minutes.

Many floor structures of rail vehicles are made of metallic floor structure, such as aluminum structures which melts at about 660° C. and would therefore not be able to withstand temperatures as high as 850° C.

There is therefore a need for heat resistant floor assemblies for rail vehicles, for heat resistant panel assemblies for rail vehicles and for heat resistant assemblies for providing structures with heat resistant properties.

SUMMARY

According to an embodiment, there is provided a heat resistant floor assembly for a rail vehicle, the heat resistant floor assembly comprising: a floor structure; and a fire protection panel made of a composite material connected underneath the floor structure.

The heat resistant floor assembly may further comprise an insulation layer between the floor structure and the fire protection panel.

The composite material may comprise: a resin; and a woven fiber reinforcement layer embedded within the resin.

The resin may comprise a polyester resin.

The woven reinforcement layer may comprise a 0/90 woven reinforcement layer.

The floor structure may define a longitudinal axis and further wherein the woven reinforcement layer comprises a plurality of fibers substantially aligned with the longitudinal axis of the floor structure.

The composite material may further comprise a woven basalt fiber layer.

The fire protection panel may define a lower portion and an exterior portion and further wherein the woven basalt fiber layer is located at the lower portion of the fire protection panel and at the exterior of the fire protection panel.

The composite material may comprise: a resin, the resin being a polyester resin; a chopped fiber reinforcement layer (also known as a mat); and a woven basalt fiber layer, the woven basalt fiber layer being located at a lower portion of the fire protection panel and at an exterior portion of the fire protection panel, the chopped fiber reinforcement layer and the woven basalt layer being embedded within the resin.

The resin may comprise a fire retardant resin.

The insulation layer may comprise rock wool.

The fire protection panel may comprise a fiber content of at least 20%.

The fire protection panel may be attached to the floor structure through a plurality of attachment assemblies, each one of the plurality of attachment assemblies comprising: a threaded stud hanging from the floor structure, the threaded stud being routed through a corresponding hole in the fire protection panel; a nut being threaded on the threaded stud for retaining the fire protection panel in place; and a washer being located between the fire protection panel and the nut, the washer being made of the same composite material as the fire protection panel.

The fire protection panel may have a thickness of less than 4 mm.

The fire protection panel may comprise a plurality of sub-panels, each one of the plurality of sub-panels overlapping at least two other of the plurality of sub-panels, thereby defining an overlapping region, and further wherein an intumescent tape interfaces between two adjacent sub-panels in the overlapping region.

The resin may comprise an intumescent resin.

According to another embodiment, in a heat resistant floor assembly for a rail vehicle, the improvement consisting of: a fire protection panel made of a composite material connected underneath a floor structure.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed a heat resistant floor assembly for a rail vehicle for providing a structure of heat resistant properties.

Figure 1:
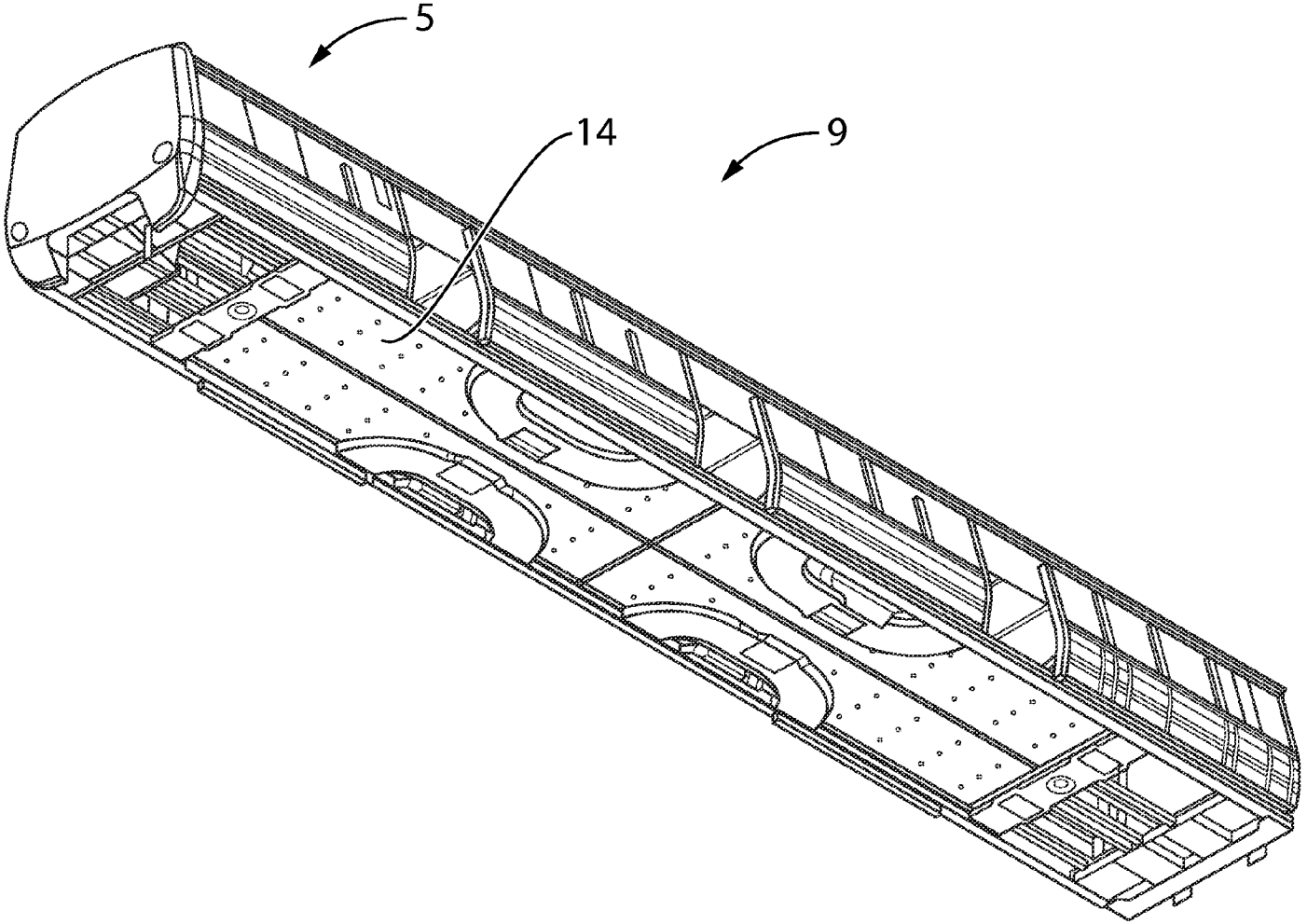
FIG. 1 is an isometric view of an undercar architecture in accordance with an embodiment.

Referring now to the drawings, and more particularly to FIG. 1, there is shown an isomeric view of a rail vehicle 5 and of its undercar architecture 9 in accordance with an embodiment.

Figure 2:
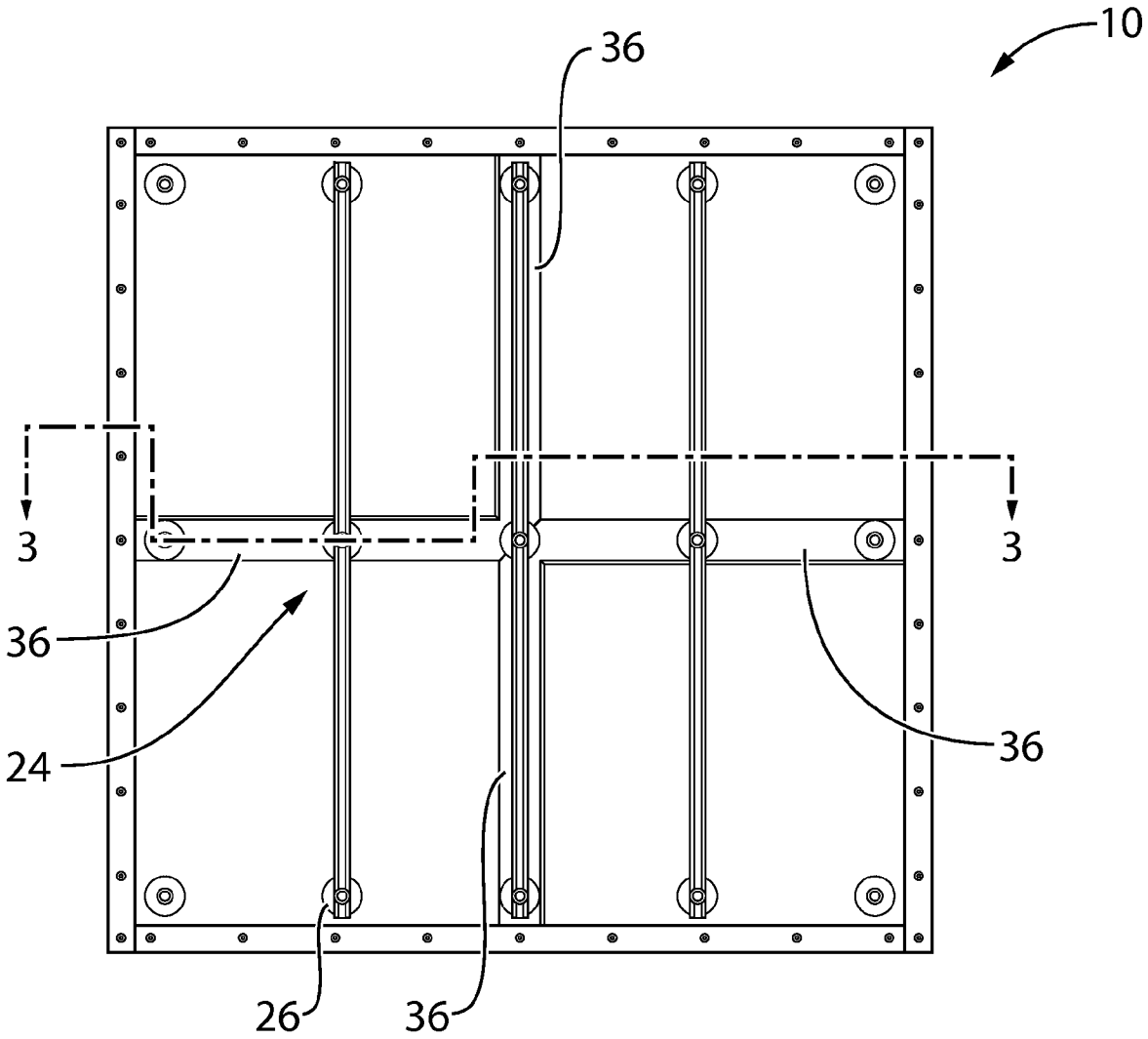
FIG. 2 is a bottom view of a heat resistant floor assembly for a rail vehicle in accordance with another embodiment.
Figure 3:
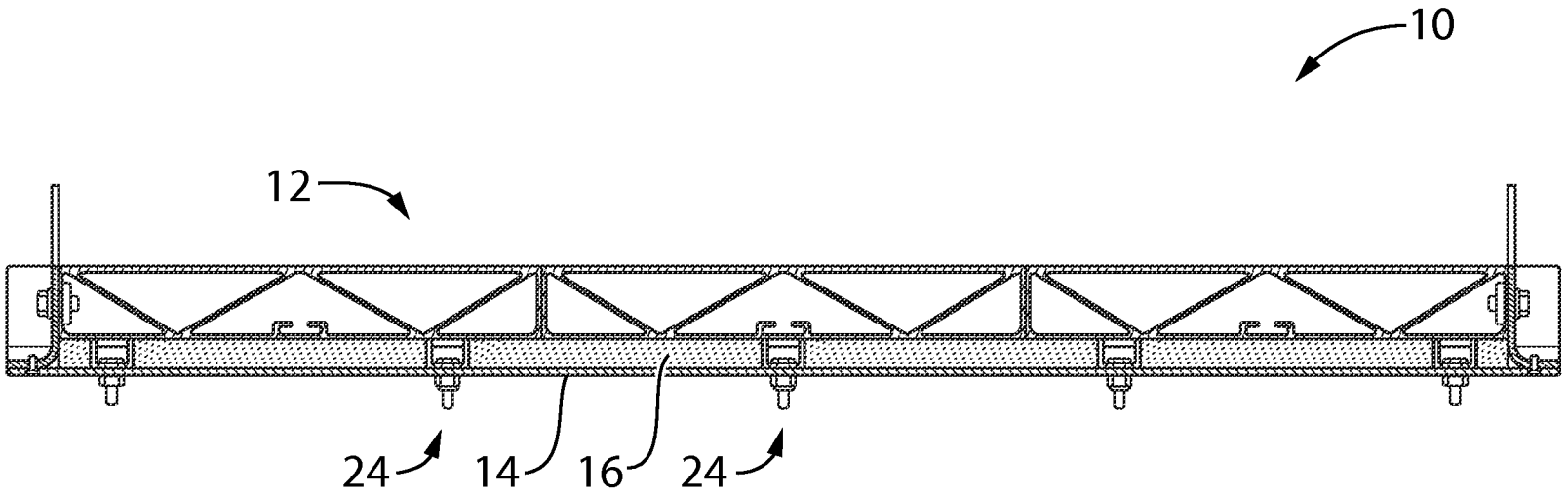
FIG. 3 is a cross sectional view taken along line A-A of the heat resistant floor assembly for a rail vehicle of FIG. 2.
Figure 4:
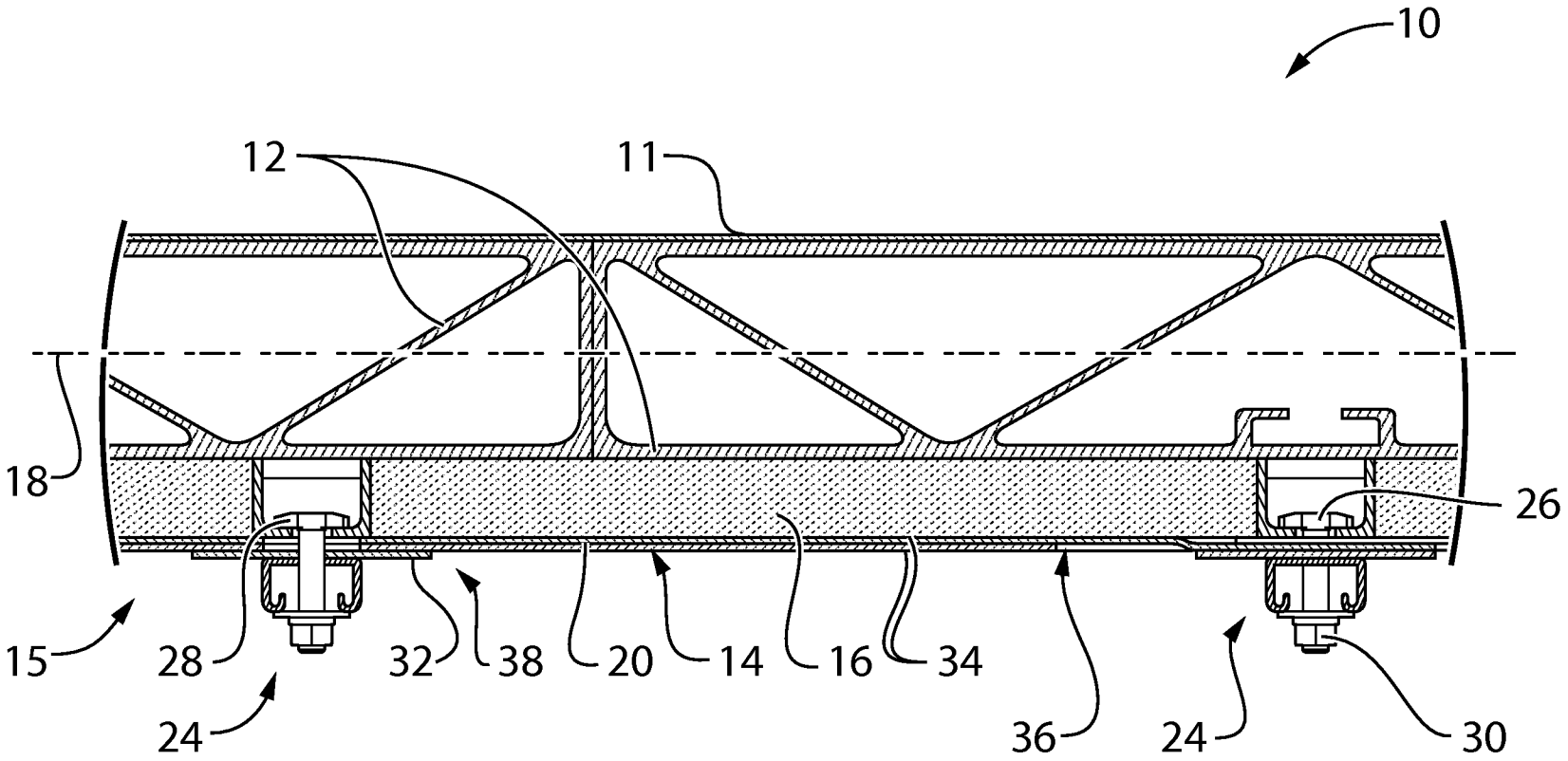
FIG. 4 is a partial view of the heat resistant floor assembly for a rail vehicle of FIG. 3.
Figure 5:
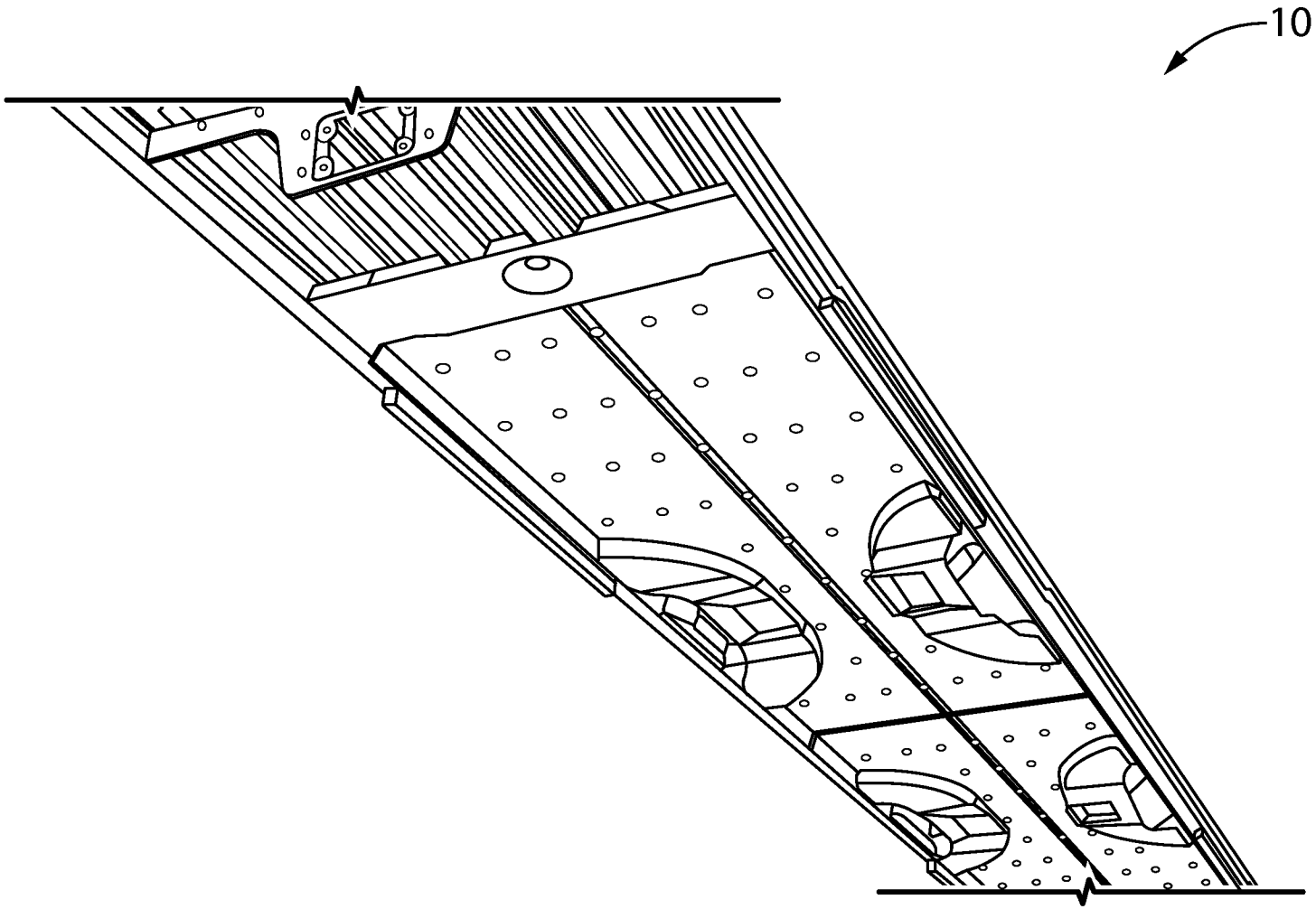
FIG. 5 is a perspective bottom view of a heat resistant floor assembly for a rail vehicle in accordance with another embodiment.
Figure 6:
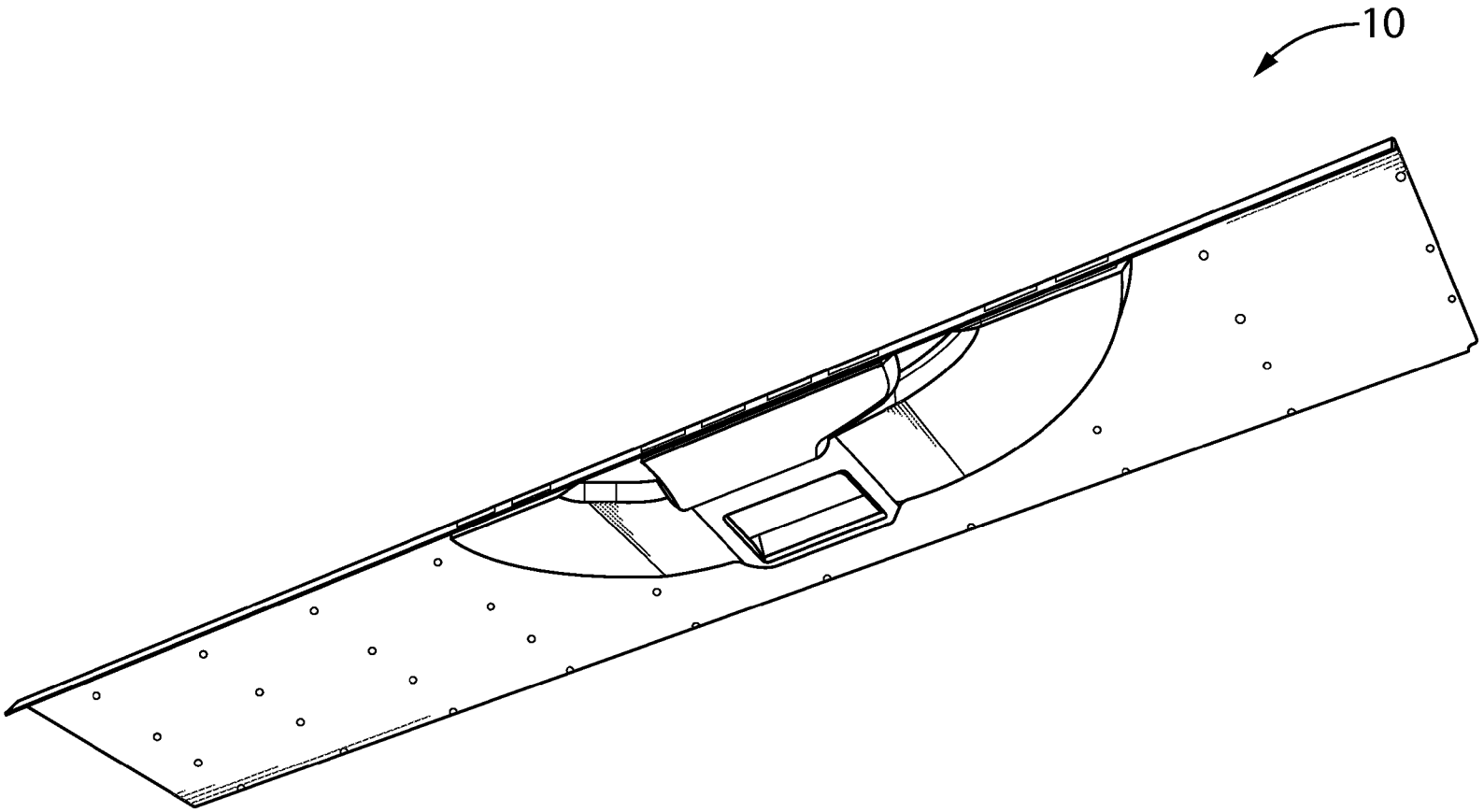
FIG. 6 is close up view of FIG. 5 showing the fire protection panel for a rail vehicle having an optional ventilation duct installed under it.
Figure 7:
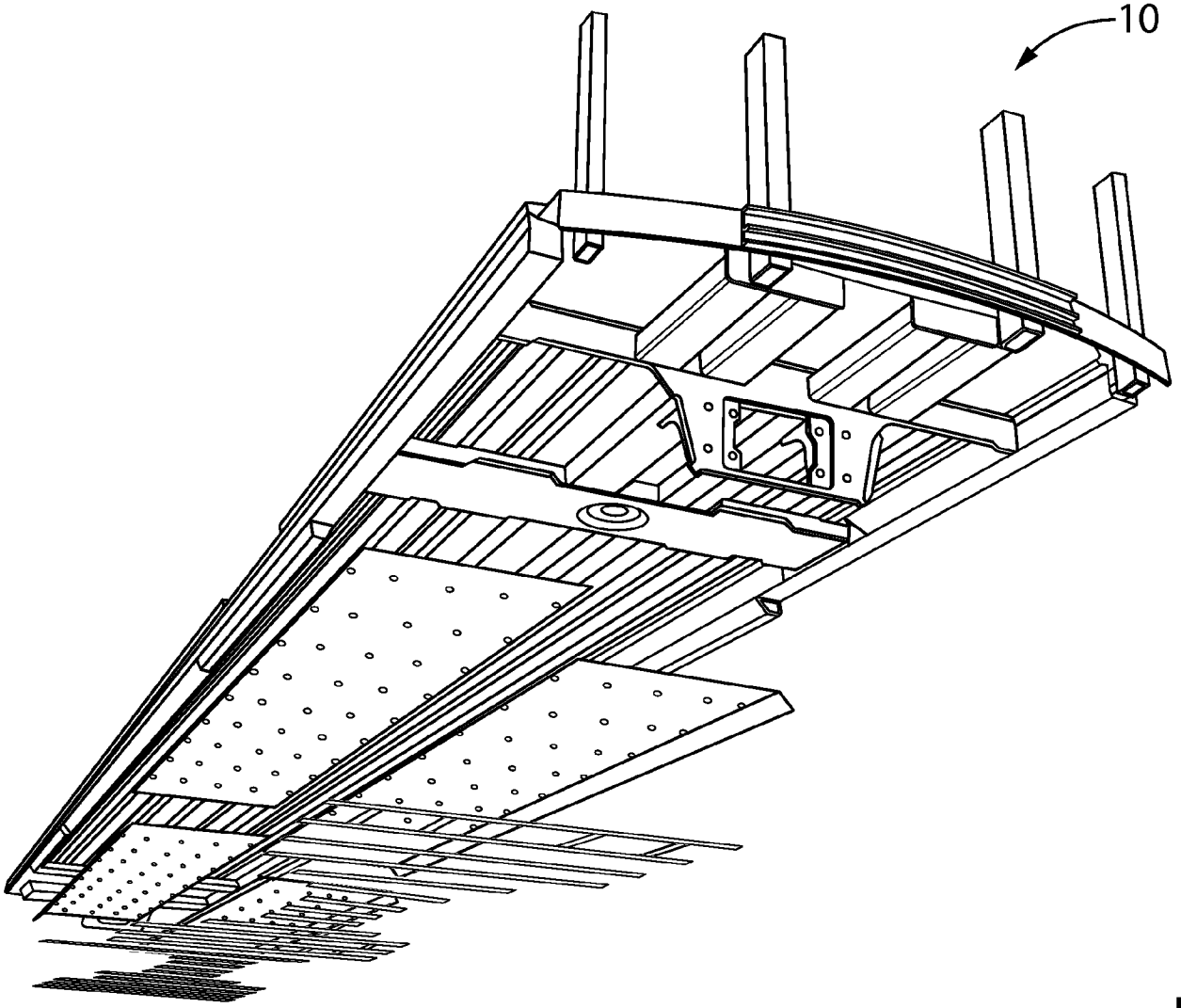
FIG. 7 is an exploded perspective view of a heat resistant floor assembly for a rail vehicle in accordance with another embodiment.
Figure 8:
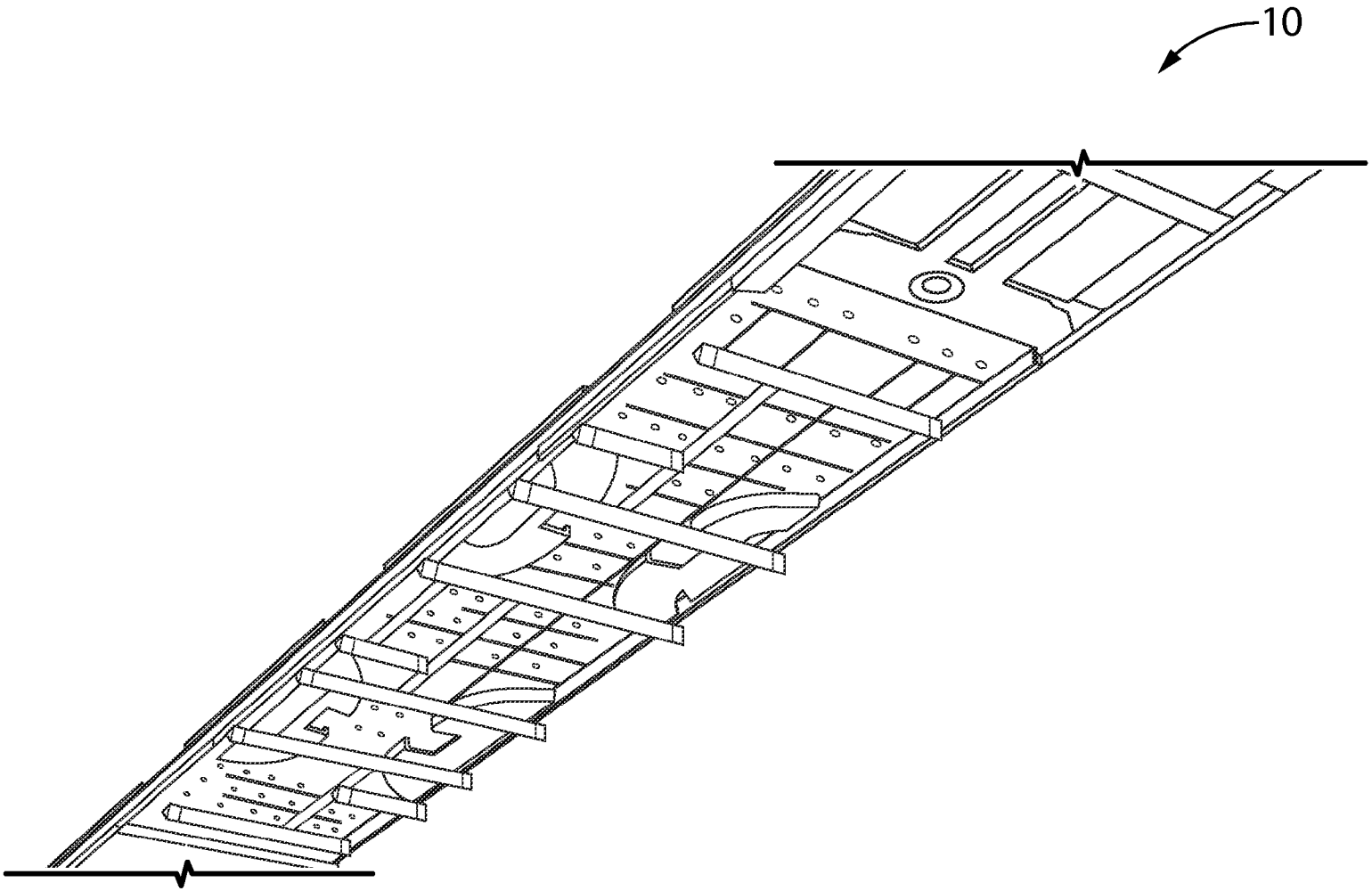
FIG. 8 is a perspective bottom view of a heat resistant floor assembly for a rail vehicle in accordance with another embodiment.

According to an embodiment and referring to FIGS. 2-4, there is shown a heat resistant panel assembly 15 for a rail vehicle. The heat resistant panel assembly 15 includes a fire protection panel 14 made of a composite material. The composite material includes a fire retardant resin and a woven fiber reinforcement layer embedded within the resin. The fire protection panel 14 has at least one opening 28 configured for receiving an attachment therethrough. The person skilled in the art will likely recognize that bolting is only one way of attaching the panel to a floor structure 12 and that alternative attachment methods, such as bonding, riveting, screwing, and other known methods may be used as well. The heat resistant panel assembly 15 may also include at least one washer 32 made of a composite material which includes a fire retardant resin and a woven fiber reinforcement layer or a chopped fiber reinforcement layer (also known as a mat) embedded within the resin. The washer 32 is fixed with an intumescent tape 38 to overlap the periphery of the opening 28 to provide a tight seal around the attachment and the opening 28. In case of a fire, the intumescent tape 38 may expand to provide a tight seal around the attachment and the openings 28 thereby preventing the fire from reaching behind the heat resistant panel assembly 15.

Additionally, FIGS. 2-4 illustrate a heat resistant floor assembly 10 for a rail vehicle 5 (FIG. 1). The heat resistant floor assembly 10 includes the floor structure 12 and a fire protection panel 14 made of a composite material. The fire protection panel 14 is connected underneath the floor structure 12. The heat resistant floor assembly 10 may also include an insulation layer 16 between the floor structure 12 and the fire protection panel 14. It is to be noted that a floor coating or floor finishing material 11 may be installed on the floor structure 12. The floor structure 12 may be made of steel, aluminum, composite materials or any other suitable material. In the case depicted in FIGS. 2-4, the floor structure 12 is made of aluminum extrusions.

According to an embodiment, the composite material includes a resin and a woven fiber reinforcement layer embedded within the resin. The resin may include a polyester resin or any other suitable resin. Preferably, the resin is a polyester resin. For example, the polyester resin may be a Firepel® K120-MTD-00 Fire retardant resin and/or a Norsodyne® H 81269 TF flame retardant polyester resin. The woven reinforcement layer may include a 0/90 woven reinforcement layer.

As shown in FIGS. 3-4, the floor structure 12 of the heat resistant floor assembly 10 defines a transversal axis 18. The woven reinforcement layer preferably includes a plurality of fibers substantially aligned with the transversal axis 18 of the floor structure 12.

Figure 9:
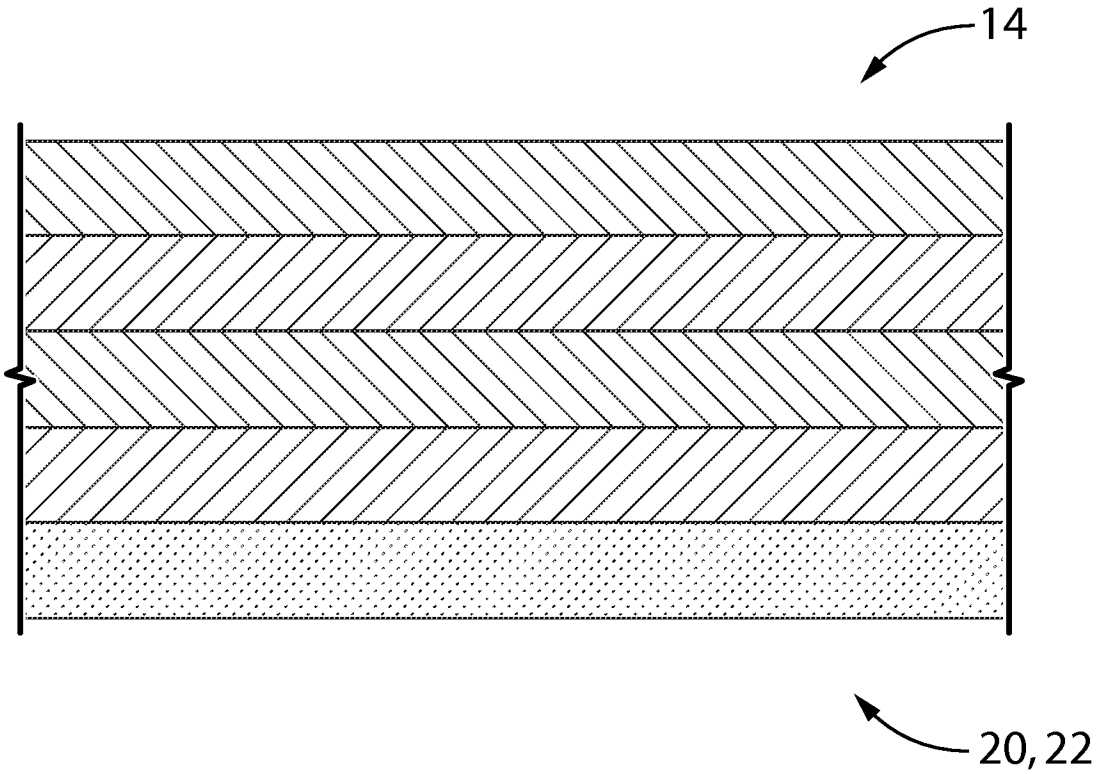
FIG. 9 is a schematic view of the reinforcement layers.

According to another embodiment, the composite material may further include a woven basalt fiber layer as shown in FIG. 9. FIG. 9, representing a schematic view of the reinforcement layers (i.e., the reinforcement layers and the basalt layer) is now referred to.

The fire protection panel 14 defines a lower portion 20 and an exterior portion 22 and the woven basalt fiber layer may be located at the lower portion 20 of the fire protection panel 14

According to another embodiment, the composite material includes a resin, preferably a polyester resin, a chopped fiber reinforcement layer and a woven basalt fiber layer. According to this embodiment, the woven basalt fiber layer is located at the lower portion 20 of the fire protection panel 14 and at the exterior portion 22 of the fire protection panel 14 in order to support the chopped fiber reinforcement layer during a fire. Additionally, the chopped fiber reinforcement layer and the woven basalt layer are embedded within the resin.

According to another embodiment, the resin may include a fire retardant resin or may include fire retardant additives to make the resin fire retardant and the insulation layer may include a rock wool material. Preferably, the resin defined by the heat resistant floor assembly 10 is a fire retardant resin and the insulation layer is made of a rock wool material.

According to another embodiment, the fire protection panel 14 may include a fiber content of at least 20% (i.e.: mass or volume).

Still referring to FIGS. 3-4, there is shown that the fire protection panel 14 is attached to the floor structure 12 through a plurality of attachment assemblies 24. Each one of the plurality of attachment assemblies 24 includes a threaded stud 26 hanging from the floor structure 12. The threaded stud 26 is routed through a corresponding opening 28 in the fire protection panel 14. The attachment assemblies 24 also include a nut 30 being threaded on the threaded stud 26 for retaining the fire protection panel 14 in place and the washer 32 which is located between the fire protection panel 14 and the nut 30. The washer 32 may be made of the same composite material as the fire protection panel 14 or of another material which can withstand high temperatures, such as steel. The fire protection panel 14 may be made of a plurality of sub-panels 34. Each one of the plurality of sub-panels 34 overlaps at least one other of the plurality of sub-panels 34 for defining an overlapping region 36. Furthermore, an intumescent tape 38 is used between two adjacent sub-panels 34 in the overlapping region 36 to seal the fire protection panel 14 and prevent fire from reaching behind it. The resin may also include an intumescent resin.

According to another embodiment, the fire protection panel 14 of the heat resistant floor assembly 10 has a thickness of less than 4 mm.

With the resin which includes an intumescent resin, the intumescent tape, the fire panel being made of a composite material which is fire resistant and the washer being made of a fire resistant composite material, the heat resistant floor assembly provides to rail vehicles (i.e.: wall structures, floor structures, ceiling structures and the like) very good heat resistant properties.

According to another embodiment, there is provided a heat resistant assembly (not shown) for providing a structure having heat resistant properties. The heat resistant assembly defines a structure similar to the structure of the heat resistant floor assembly. The heat resistant assembly includes one of a floor structure, a wall structure and a ceiling structure, a fire protection panel made of a composite material connected underneath the one of the floor structure, the wall structure and the ceiling structure and an insulation layer between the one of the floor structure, the wall structure and the ceiling structure and the fire protection panel. The fire protection panel is attached to the one of the floor structure, the wall structure and the ceiling structure through a plurality of attachment assemblies. Each one of the plurality of attachment assemblies includes a threaded stud which hangs from the one of the floor structure, the wall structure and the ceiling structure. The threaded stud is routed through a corresponding opening in the fire protection panel. Each one of the plurality of attachment assemblies also includes a nut which is threaded on the threaded stud for retaining the fire protection panel in place and a washer located between the fire protection panel and the nut. The washer is made of the same composite material as the fire protection panel in the heat resistant assembly as well.

The composite material of the heat resistant assembly also includes a resin and a woven fiber reinforcement layer embedded within the resin. The resin may also include a polyester resin.

The fire protection panel of the heat resistant assembly may also include a plurality of sub-panels. Each one of the plurality of sub-panels overlaps at least one other of the plurality of sub-panels for defining an overlapping region. An intumescent tape also interfaces between the adjacent sub-panels in the overlapping region to prevent fire from infiltrating between two adjacent sub-panels.

With the resin which includes an intumescent resin, the intumescent tape, the fire panel being made of a composite material which is fire resistant and the washer being made of a fire resistant composite material, the heat resistant assembly provides to structures (i.e.: wall structures, floor structures, ceiling structures and the like) heat resistant properties.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A heat resistant floor assembly for a rail vehicle, the heat resistant floor assembly comprising:

a floor structure; and a fire protection panel made of a composite material connected underneath the floor structure;

wherein the composite material comprises:

an intumescent resin;

a chopped fiber reinforcement layer; and a woven basalt fiber layer, and wherein the chopped fiber reinforcement layer and woven basalt fiber layer are embedded within the intumescent resin, wherein the fire protection panel is arranged so that the chopped fiber reinforcement layer is intermediate the floor structure and the woven basalt fiber layer, the woven basalt fiber layer being located at a lower portion of the first protection panel and at an exterior portion of the fire protection panel so as to support said chopped fiber reinforcement layer during a fire, wherein the fire protection panel is attached to the floor structure through a plurality of attachment assemblies, each one of the plurality of attachment assemblies comprising a threaded stud hanging from the floor structure, the threaded stud being routed through a corresponding opening in the fire protection panel; and wherein the fire protection panel comprises a plurality of sub-panels, each one of the plurality of sub-panels overlapping at least two other of the plurality of sub-panels, thereby defining an overlapping region, wherein the corresponding opening in the fire protection panel, through which the threaded stud is routed, extends through the overlapping region.

2. The heat resistant floor assembly of claim 1, further comprising an insulation layer between the floor structure and the fire protection panel.

3. The heat resistant floor assembly of claim 1, wherein the fiber reinforcement layer is a woven fiber reinforcement layer.

4. The heat resistant floor assembly of claim 3, wherein the resin comprises a polyester resin.

5. The heat resistant floor assembly of claim 3, wherein the woven reinforcement layer comprises a 0/90 woven reinforcement layer.

6. The heat resistant floor assembly of claim 3, wherein the floor structure defines a longitudinal axis and further wherein the woven reinforcement layer comprises a plurality of fibers substantially aligned with the longitudinal axis of the floor structure.

7. The heat resistant floor assembly of claim 3, wherein the resin comprises a fire retardant resin.

8. The heat resistant floor assembly of claim 1, wherein the resin comprises a fire retardant resin.

9. The heat resistant floor assembly of claim 1, wherein the insulation layer comprises rock wool.

10. The heat resistant floor assembly of claim 1, wherein the fire protection panel comprises a fiber content of at least 20% by weight.

11. The heat resistant floor assembly of claim 1, wherein each one of the plurality of attachment assemblies further comprises:

a nut being threaded on the threaded stud for retaining the fire protection panel in place; and a washer being located between the fire protection panel and the nut, the washer being made of the same composite material as the fire protection panel.

12. The heat resistant floor assembly of claim 1, wherein the fire protection panel has a thickness of less than 4 mm.

13. The heat resistant floor assembly of claim 1, wherein an intumescent tape interfaces between two adjacent sub-panels in the overlapping region.

14. In a heat resistant floor assembly for a rail vehicle, the improvement consisting of:

a fire protection panel made of a composite material connected underneath a floor structure;

wherein the composite material comprises:

an intumescent resin;

a chopped fiber reinforcement layer embedded within the resin; and a woven basalt fiber layer, the chopped fiber reinforcement layer and the woven basalt layer being embedded within the resin, wherein the fire protection panel is arranged so that the chopped fiber reinforcement layer is intermediate the floor structure and the woven basalt fiber layer, the woven basalt fiber layer being located at a lower portion of the first protection panel and at an exterior portion of the fire protection panel so as to support said chopped fiber reinforcement layer during a fire, wherein the fire protection panel comprises a plurality of sub-panels, each one of the plurality of sub-panels overlapping at least two other of the plurality of sub-panels, thereby defining an overlapping region, wherein an opening in the fire protection panel, through which a threaded stud is routed to connect the fire protection panel to the floor structure, extends through the overlapping region.

15. The heat resistant floor assembly of claim 14, wherein the fiber reinforcement layer is a woven fiber reinforcement layer.

16. The heat resistant floor assembly of claim 15, wherein the resin comprises a polyester resin.

17. The heat resistant floor assembly of claim 15, wherein the woven reinforcement layer comprises a 0/90 woven reinforcement layer.

18. The heat resistant floor assembly of claim 15, wherein the floor structure defines a longitudinal axis and further wherein the woven reinforcement layer comprises a plurality of fibers substantially aligned with the longitudinal axis of the floor structure.

19. The heat resistant floor assembly of claim 14, wherein the resin comprises a fire retardant resin.

20. The heat resistant floor assembly of claim 14, further comprising an insulation layer between the floor structure and the fire protection panel, wherein the insulation layer comprises rock wool.

21. The heat resistant floor assembly of claim 14, wherein the fire protection panel comprises a fiber content of at least 20% by weight.

22. The heat resistant floor assembly of claim 14, wherein the fire protection panel has a thickness of less than 4 mm.

23. The heat resistant floor assembly of claim 14, wherein an intumescent tape interfaces between two adjacent subpanels in the overlapping region.

* * * * *